US007661977B2

(12) United States Patent
Zayas et al.

(10) Patent No.: US 7,661,977 B2
(45) Date of Patent: Feb. 16, 2010

(54) SNAP-LOCK CONNECTOR

(75) Inventors: Betty Jean Zayas, Bridgeport, CT (US); Christian L. Sauska, Fairfield, CT (US)

(73) Assignee: Light Sources, Inc., Orange, CT (US)

( * ) Notice: Subject to any disclaimer, the term of this patent is extended or adjusted under 35 U.S.C. 154(b) by 0 days.

(21) Appl. No.: 12/364,150

(22) Filed: Feb. 2, 2009

(65) Prior Publication Data

US 2009/0156037 A1 Jun. 18, 2009

Related U.S. Application Data

(63) Continuation-in-part of application No. 11/860,988, filed on Sep. 25, 2007, now Pat. No. 7,497,719.

(60) Provisional application No. 60/846,980, filed on Sep. 25, 2006.

(51) Int. Cl.
*H01R 13/62* (2006.01)

(52) U.S. Cl. ..... 439/357

(58) Field of Classification Search ..... 439/356, 439/357, 617, 618, 232

See application file for complete search history.

(56) References Cited

U.S. PATENT DOCUMENTS

| | | | |
|---|---|---|---|
| 2,227,739 | A | 1/1941 | Pollard |
| 2,836,646 | A | 5/1958 | Paolinelli |
| 3,601,699 | A | 8/1971 | Norton, Jr. et al. |
| 3,638,170 | A | 1/1972 | Clement et al. |
| 4,623,823 | A | 11/1986 | Engel |
| 4,700,101 | A | 10/1987 | Ellner et al. |
| 4,713,019 | A | 12/1987 | Gaynor |
| 4,906,891 | A | 3/1990 | Takagi et al. |

(Continued)

FOREIGN PATENT DOCUMENTS

| | | |
|---|---|---|
| WO | 01/030399 | 5/2001 |

(Continued)

OTHER PUBLICATIONS

Witham, et al. "Apparatus and Method for Keying Lamp and Lamp Fixture," U.S. Appl. No. 60/440,908, filed Jan. 15, 2003. Specification having 11 pages, Figures having 3 sheets.

(Continued)

*Primary Examiner*—Phuong K Dinh
(74) *Attorney, Agent, or Firm*—Cantor Colburn, LLP

(57) ABSTRACT

An end cap may include an end cap body that is tubular in shape, an end cap face provided at a first end of the end cap body, a plurality of end cap terminals provided on the end cap face, and a clip notch provided on an exterior side of the end cap body. The second end of the end cap body may be open and structured to receive the lamp therein. A socket may include a socket body that is generally tubular in shape, a socket face provided at a first end of the socket body, a receiving wall extending from an outer periphery of the socket face and extending in a direction away from the socket body, a plurality of socket terminals provided on the socket, and a resilient clip provided on an inner side of the receiving wall.

22 Claims, 20 Drawing Sheets

U.S. PATENT DOCUMENTS

| | | | | |
|---|---|---|---|---|
| 4,949,007 | A | | 8/1990 | Takagi et al. |
| 5,166,527 | A | | 11/1992 | Solymar |
| 5,169,227 | A | | 12/1992 | Korte et al. |
| 5,239,226 | A | | 8/1993 | Seredich et al. |
| 5,422,487 | A | | 6/1995 | Sauska et al. |
| 5,634,820 | A | * | 6/1997 | Vakil ..... 439/646 |
| 5,752,842 | A | | 5/1998 | Friederichs et al. |
| 5,902,552 | A | | 5/1999 | Brickley |
| 5,968,455 | A | | 10/1999 | Brickley |
| 6,190,191 | B1 | | 2/2001 | Pasternak |
| 6,268,607 | B1 | | 7/2001 | Marsh et al. |
| 6,340,310 | B2 | | 1/2002 | Henrici et al. |
| 6,500,387 | B1 | | 12/2002 | Bigelow |
| 6,634,902 | B1 | | 10/2003 | Pirovic |
| 6,746,134 | B1 | | 6/2004 | Guzorek |
| 6,797,966 | B2 | | 9/2004 | Summers et al. |
| 6,809,326 | B2 | | 10/2004 | Disabito et al. |
| 6,838,057 | B2 | | 1/2005 | Russell et al. |
| 6,884,103 | B1 | | 4/2005 | Kovacs |
| 7,137,728 | B2 | * | 11/2006 | Witham et al. ..... 362/652 |
| 7,354,317 | B2 | | 4/2008 | Witham et al. |
| 2002/0104972 | A1 | | 8/2002 | Guzorek |
| 2003/0011308 | A1 | | 1/2003 | Crawford et al. |

FOREIGN PATENT DOCUMENTS

| | | |
|---|---|---|
| WO | 2006136026 | 12/2006 |

OTHER PUBLICATIONS

International Search Report, Application No. PCT/US06/06087, Date Mailed February 27, 2008.
International Search Report, Application No. PCT/US07/20661, Date Mailed Jul. 28, 2008.

* cited by examiner

SNAP-LOCK CONNECTOR

This is a Continuation-in-Part (CIP) application of Ser. No. 11/860,988 filed Sep. 25, 2007 which claimed priority to U.S. provisional application 60/846,980 filed Sep. 25, 2006, the entire disclosure of which is incorporated herein by reference and priority to which is also claimed hereto.

BACKGROUND OF THE INVENTION

1. Field of the Invention

This invention generally relates to improvements in lamps, especially ultraviolet lamps used in air and water purifiers, as well as lamps used in specialty applications including dedicated application, compact fluorescent and specialty fluorescent lamps.

2. Background

Ultraviolet air or liquid purifiers are known for disinfecting contaminated air or water or other liquid for domestic or commercial use. Such purifiers include at least one lamp for emitting ultraviolet radiation into a chamber through which contaminated air or liquid flows in order to kill organisms therein. Dedicated application lamps are those designed primarily for a single application. Specialty lamps are designed for, but not limited to, subminiature, reflector, cold cathode and/or electrodeless lamps. Germcidal lamps also fall within the specialty lamp definition. In a conventional manner, these lamps include two electrodes spaced apart and located within an elongated arc tube containing a gas, most commonly a noble gas, with or without additives. A pair of end caps is mounted at the ends of the tube. Each electrode contains two lead wires from the lamp seal each of which, or in some instances only one, are electrically connected to respective contact(s) or terminal pin(s). The lamp is typically inserted endwise into a sleeve installed in the water, other liquid or air with or without the sleeve. To simplify insertion and electrical connection, the pins are conveniently mounted on one or both of the end caps. When the electrodes are energized by voltage from an electrical power supply, an electrical discharge is initiated in the gas between the electrodes. This discharge reacts with mercury and causes ultraviolet radiation to be emitted from the lamp in a manner well known in the art.

There are many different types of lamps that have a base or end cap that can be connected with a socket to provide electrical connections to the lamps. The end cap and socket must be constructed to permit replacement of the lamp while securely holding the lamp. This may be particularly important in certain applications where vibration or movement of the lamp or lamp fixture could result in unintentional separation between the lamp's end cap and the socket. Additionally, the electrical connections must remain secure.

In some applications where a multiplicity of contact pins and/or pin orientations is utilized, it is often difficult to align the contact pins to make the electrical connection necessary to operate the lamp. Often, the contact pins may become misaligned or bent due to their extension or projection from the base of the lamp, preventing their insertion into a socket. It may also be possible to insert the end cap into a socket such that the contacts are not connected with the proper terminals in the socket, resulting in improper operation of the lamp. Also, on a typical "slide into place" male/female pin connector there is no locking or twist locking and thus the pins may slide out and become disconnected easily by vibration for example.

An example of an ultraviolet lamp of the type described above is disclosed in U.S. Pat. No. 5,166,527 ('527), which uses a stepped base with a multi-pin connector, all of the contents of which are incorporated herein by reference and shows well known water and air purification arrangements using a lamp. The '527 patent discloses a lamp or bulb, used as an ultraviolet lamp for use in an air or water purifier, comprising an elongated, hollow arc tube extending along a longitudinal axis between opposite end regions. The tube contains a gas, most commonly a noble gas with or without additives. A pair of electrodes is spaced apart along the longitudinal axis. The electrodes are respectively mounted within the arc tube at the end regions thereof. A pair of end caps is respectively mounted at the end regions of the arc tube. A first electrical contact or pair of electrical contacts or terminal pins extends in mutual parallelism along the longitudinal axis and is electrically connected to one or both of the electrode lead wires. A second electrical contact or pair of electrical contacts or terminal pins extends in mutual parallelism along the longitudinal axis and is electrically connected to one or both of the other of the electrode lead wires. Both pairs of pins are mounted on, and extend outwardly along the longitudinal axis of, one of the end caps. A wire conductor is, or two wire conductors are, located exteriorly of the tube and electrically connected to one pin or one pair of pins at one end region of the tube, as well as to the electrode at the other end region of the tube. This design is mainly designed to prevent electrical arcing and does not lock in place.

As noted in WO/2006/136026 to Elku et al. which is a variation of the slide-on pin connector above, a potential problem with this approach is that in many applications, the radiation lamp is immersed in or near a flow of air or water and turbulence created within that air or water treatment system invariably imparts a vibratory motion to the lamps which frequently results in lamps being vibrated or shaken loose of its electrical connection base or socket thereby causing the lamps to be rendered completely or intermittently inoperative. When such an event occurs, the air or water being treated may not be fully disinfected. The prior art has attempted to address this problem by using a relatively complicated mechanical connection (e.g., a so-called "push-and-twist" connection) to secure the lamp to the connection base. See, for example, U.S. Pat. No. 5,422,487 to Sauska et al. and U.S. Pat. No. 6,884,103 to Kovacs. The potential problem with these approaches is the complexity of the mechanical connection between the lamp and the base unit requiring the use of springs, specialized connection lugs and the like. Further, a connection system which is predicated on a dual motion system such that pushing and twisting if used incorrectly for example may give rise to higher incidents of lamp breakage, electrical shock, and other damage to the lamp by field personal. Therefore, eliminating a forceful "push" necessary to deflect a heavy locking spring in a "push and twist" lock would be beneficial because the typically glass lamp would be subject to reduced force and stress.

Also, it is important for safety that lamps of proper wattage be used for safety, heat, and fire concerns, thus a unique keying system which only allows lamps of proper wattage to be inserted into the base will also help safety.

Accordingly, there remains the need in the art for a safety lamp device, particularly for a radiation lamp, which will provide a reliable, locking, and secure from movement electric connection, yet be relatively inexpensive, uncomplicated, durable, rugged, and simple to implement with smooth operation and with reduced force and stress on the lamp for safety purposes. Also, a lamp connector that reduces the chance of electrical shock is needed for safety purposes.

Thus, there continues to be a need for improved lamp base designs, particularly ultraviolet lamps.

SUMMARY

At least an embodiment of end cap may include an end cap body that is tubular in shape, an end cap face provided at a first end of the end cap body, a plurality of end cap terminals provided on the end cap face, and a clip notch provided on an exterior side of the end cap body. The second end of the end cap body may be open and structured to receive the lamp therein.

A least an embodiment of a socket may include a socket body that is generally tubular in shape, a socket face provided at a first end of the socket body, a receiving wall extending from an outer periphery of the socket face and extending in a direction away from the socket body, a plurality of socket terminals provided on the socket, and a resilient clip provided on an inner side of the receiving wall.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

As used herein, the word "terminal" can mean, but is not limited to, an active terminal or a passive "dummy" terminal. Additionally, the term "lamp" can refer to compact fluorescent lamps, or Ultra-Violet(UV) lamps, among other lamps suitable for the claimed apparatus.

The apparatus described herein is useful in air and water purification systems, among other applications.

Figure 1:
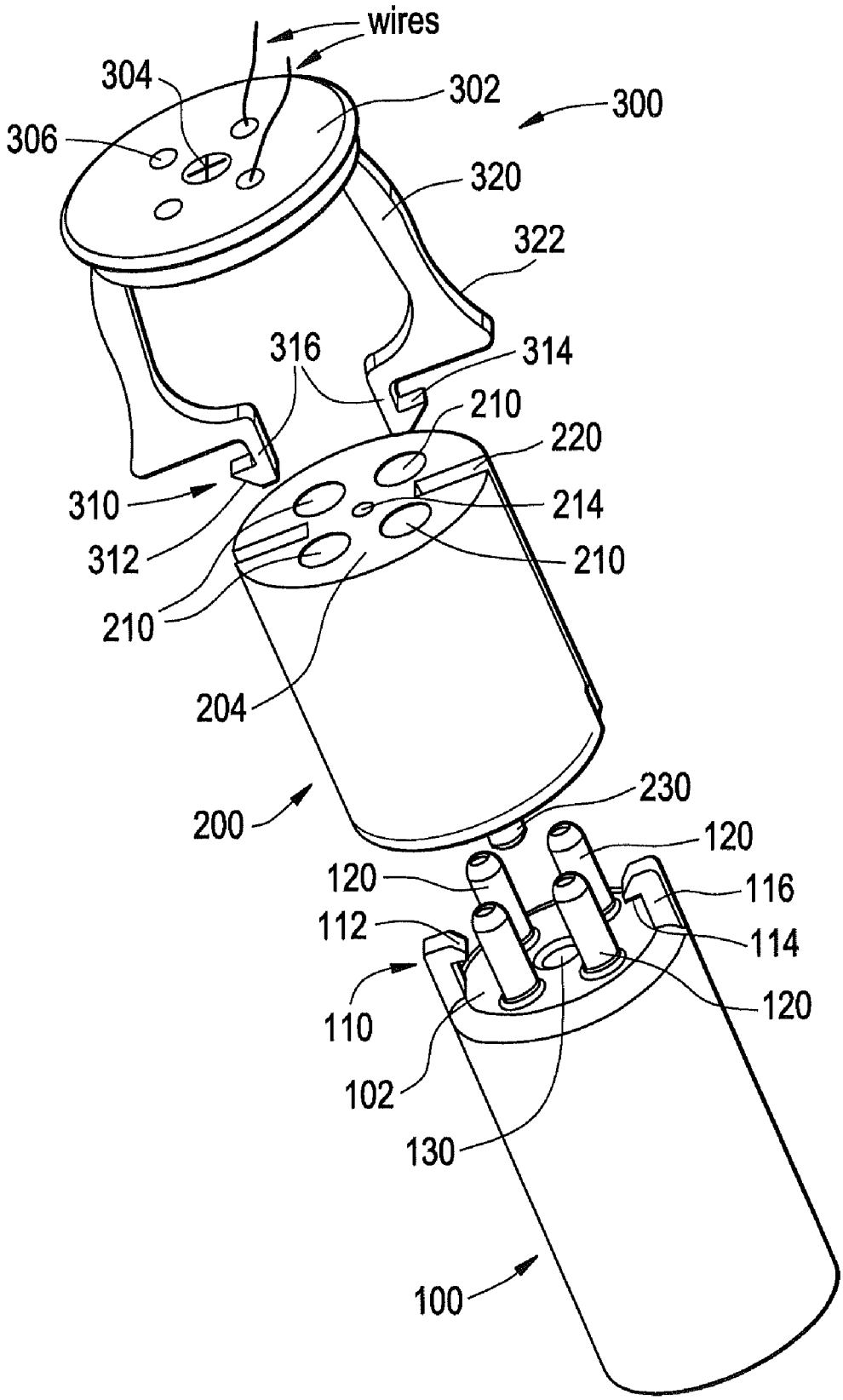
FIG. 1 is a perspective view of a disassembled end cap, socket body, and socket base in accordance with one embodiment of the invention.

FIG. 1 shows one possible embodiment of the claimed apparatus disassembled into its constituent parts. In this embodiment, the snap lock connector can include an end cap 100, a socket body 200, and a socket base 300.

Figure 2:
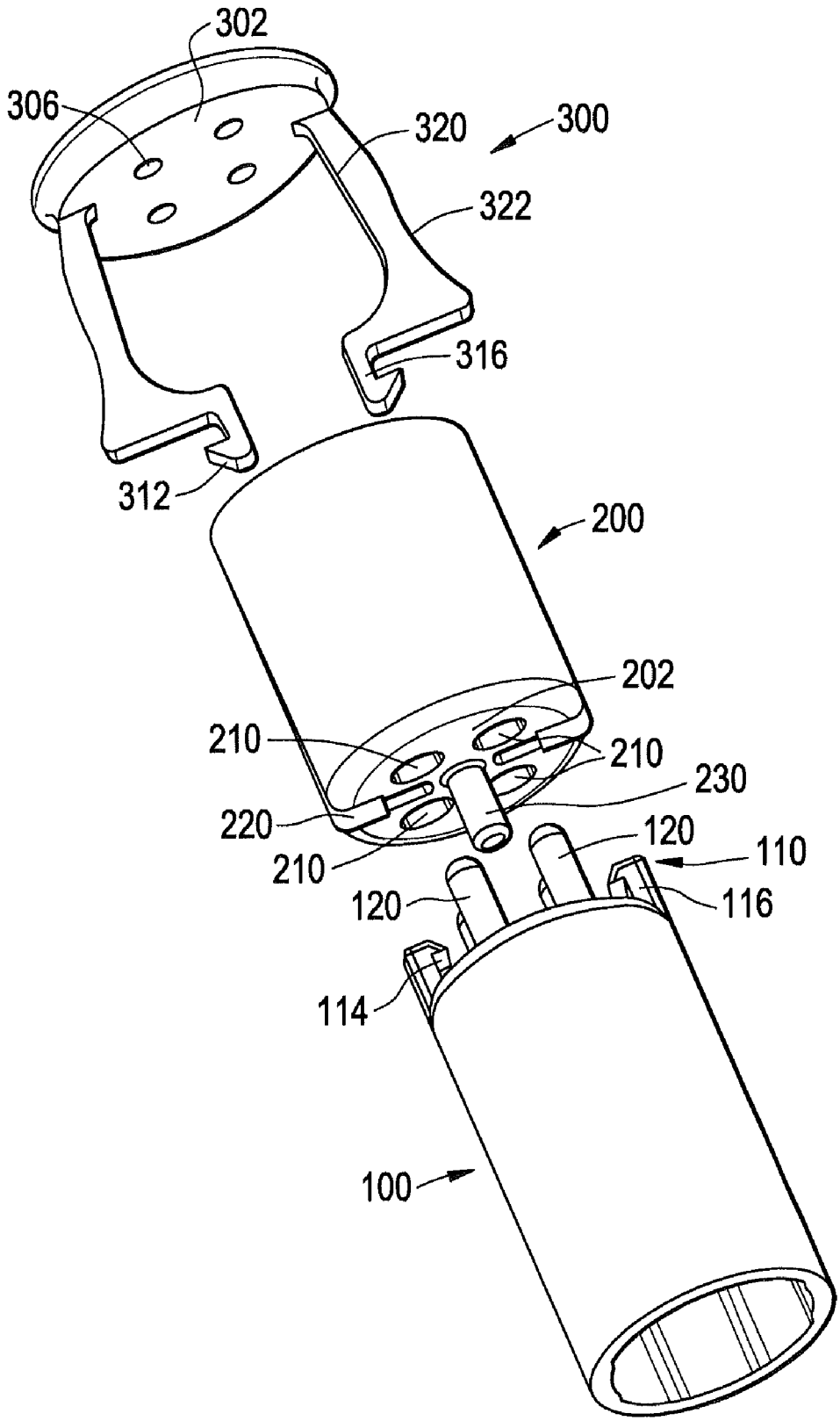
FIG. 2 is a perspective view of a disassembled end cap, socket body, and socket base in accordance with one embodiment of the invention.
Figure 3:
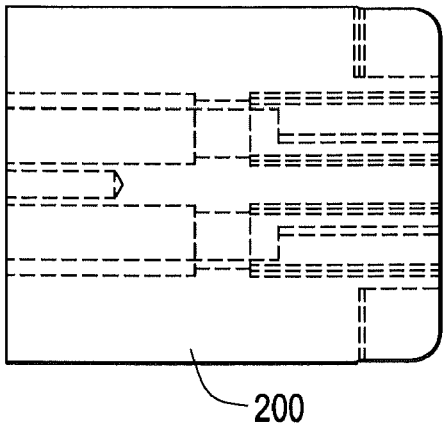
FIG. 3 is a side view of a socket body with broken lines showing interior structure, in accordance with one embodiment of the invention.
Figure 4:
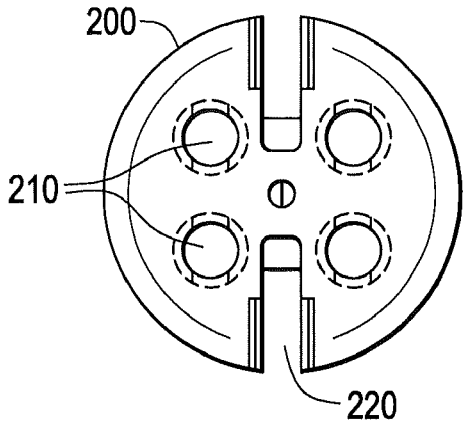
FIG. 4 is a top view of a socket body, in accordance with one embodiment of the invention.
Figure 5:
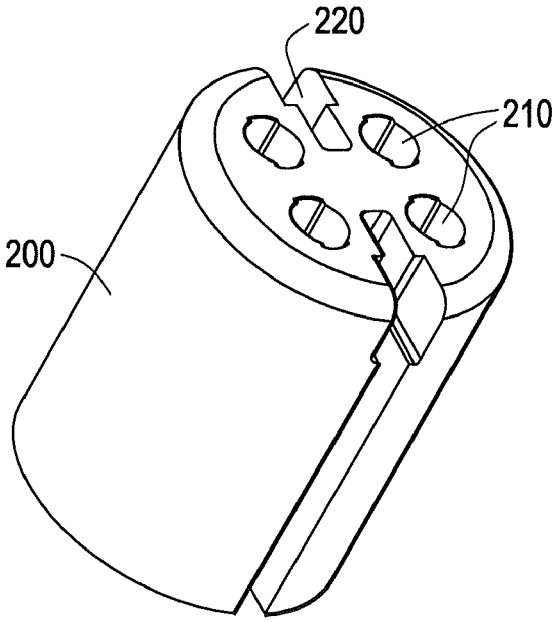
FIG. 5 is a perspective view of a socket body, in accordance with one embodiment of the invention.
Figure 10:
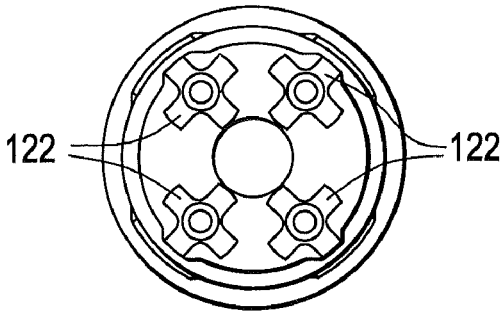
FIG. 10 is a view looking down into an end cap in accordance with one embodiment of the invention.

As seen in FIGS. 1-2, end cap 100 in this embodiment can have a hollow tubular body into which a lamp can be inserted. As seen in FIG. 10, end cap 100 can have a number of interior contacts 122. These contacts are electrically connected to end cap pins 120, shown in FIGS. 1 and 2. End cap pins 120 extend from closed end 102 of end cap 100 in a direction parallel to the longitudinal axis of end cap 100. End cap 100 can also have end cap hole 130 for receiving a socket pin 230, as described below.

Additionally, end cap 100 can have at least one end cap clip 110. In the particular embodiment illustrated in FIGS. 1 and 2, end cap 100 has two end cap clips 110 disposed opposite of each other on the outer circumference of closed end 102. However, one can easily conceive how either more or less than two clips can be used. Furthermore, the clips do not have to be located opposite each other or symmetrically disposed; one can easily conceive of alternatives in which the clips are asymmetrically disposed on closed end 102 of end cap 100.

End cap clips 110 comprise three main parts, the clip leg 116, a slanted pushing face 112, and a flat locking face 114. Clip legs 116 extend from the closed end 102 in a direction parallel to the longitudinal axis of the end cap 100. Flat locking face 114 extends perpendicular from clip leg 116. Slanted pushing face 112 extends from the end of flat locking face 114 to the terminal end of clip leg 116.

As seen in FIGS. 1 and 2, in this particular embodiment, socket body 200 is a generally cylindrical body. Socket body 200 has two ends, an insertion end 202 and a base end 204. Socket body 200 also has a number of socket channels 210 running through the entire length of a socket body 200. Socket channels 210 are lined with electrically conductive material or otherwise configured so that a pin or wire contacting one end of socket channel 210 will automatically be in electrical contact with the other end of socket channel 210.

End cap pins 120 can be inserted into socket channels 210 at the insertion end 202 of socket body 200. Because socket channels 210 are electrically conductive as described above, inserting end cap pins 120 into socket channels 210 will make end cap pins 120 electrically connected to the end of socket channels 210 opening on the base end 204 of socket body 200.

Socket body 200 may also include a socket pin 230. Socket pin 230 can insert into end cap hole 130 at the same time that end cap pins 120 are inserted into socket channels 210. Socket pin 230 can be used as a guide for proper insertion of end cap pins 120 into socket channels 210, or as a means of deterring the use of counterfeit, copied, or generic parts which may be unsafe. For example, authorized parts may be of the wrong or excessive wattage rating and/or manufactured poorly.

Socket body 200 can also include at least one clip slot 220. Clip slot 220 is a groove cut into the side of socket body 200 and extends from insertion end 202 to base end 204. Generally, the number of clip slots 220 will correspond to the number of end cap clips 110. Clips slots 220 are aligned with end cap clips 110.

As seen particularly in FIG. 1, socket body 200 can also include a screw hole 214. Screw hole 214 receives a screw that attaches socket base 300 to socket body 200, as described below.

As seen in FIGS. 1 and 2, in this particular embodiment, socket base 300 comprises two main parts, a socket base plate 302 and clip arms 320. Socket base 300 can be attached to base end 204 of socket body 200.

Socket base plate 302 can be round in shape and having a certain thickness dimension. A screw 304 can extend through socket base plate 302 for attaching the socket base 300 to the socket body 200. Socket base plate 302 also has a number of socket base holes 306 that align with socket channels 210 of socket body 200. As shown in FIG. 1, "wires" or other power source connections can be inserted through socket base holes 306, and then can be electrically connected to socket channels 210. Therefore, "wires" can be electrically connected to end cap pins 120 through socket channels 210.

Clip arms 320 are disposed along the outer circumference socket base plate 302 and extend generally perpendicular to socket base plate 302. Clip arms 320 are aligned with clips slots 220 when socket base 300 is attached to socket body 200. Clip arms 320 can include a pressure area 322 and a clip section 316. Clip arms 320 are flexible and resilient and flex inward toward a longitudinal axis of socket base 300 when pressure is applied to pressure areas 322.

Clip section 310 is similar in structure to end cap clips 110. Clip section 310 includes a clip leg 316, flat locking face 314, and slanted pushing face 312. Flat locking face extends perpendicular to clip legs 316. Slanted pushing face 312 extends from the end of flat locking face 314 to the terminal end of clip leg 316.

Figure 11:
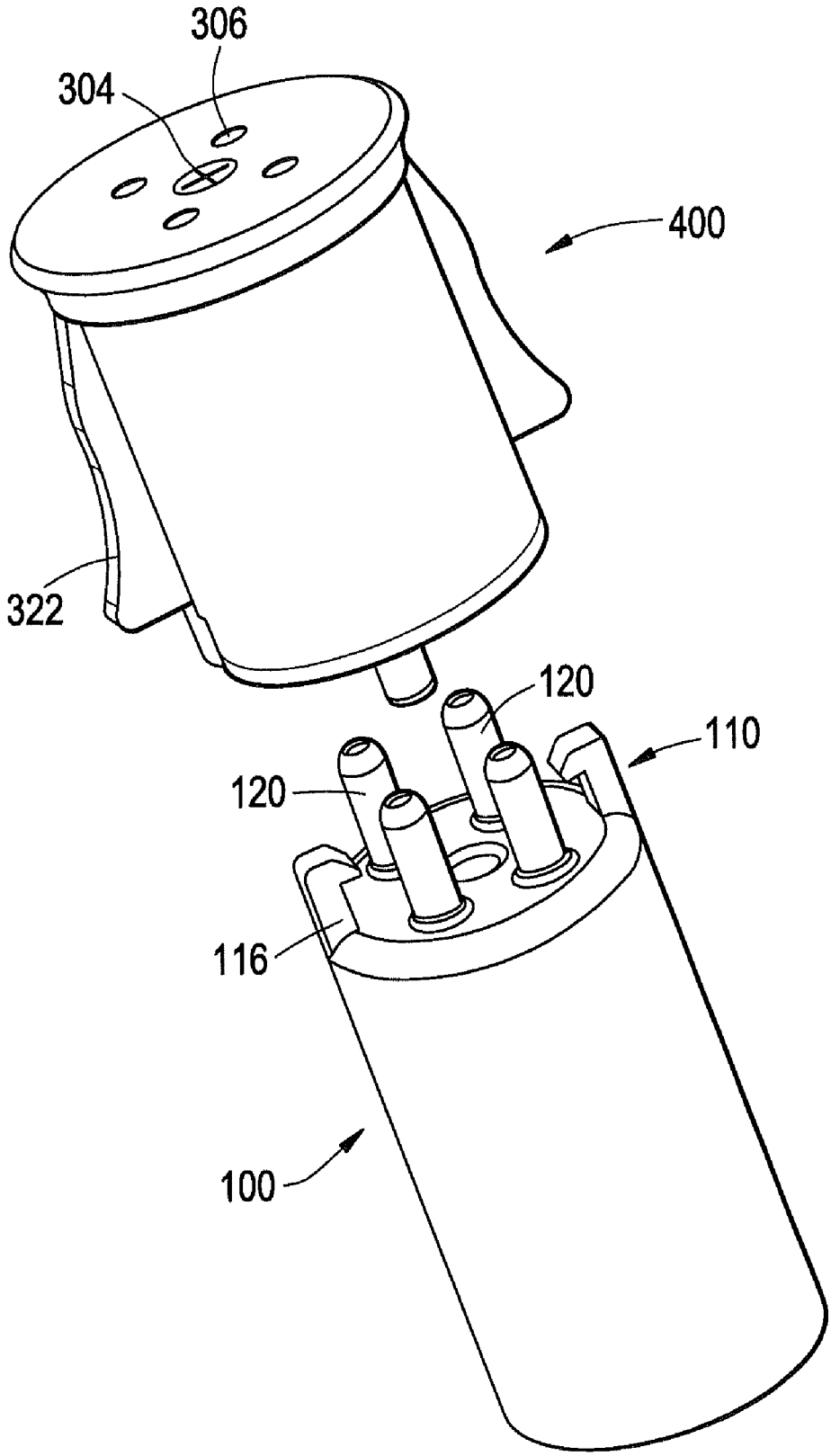
FIG. 11 is a perspective view of an end cap and an assembled socket assembly in accordance with one embodiment of the invention.
Figure 12:
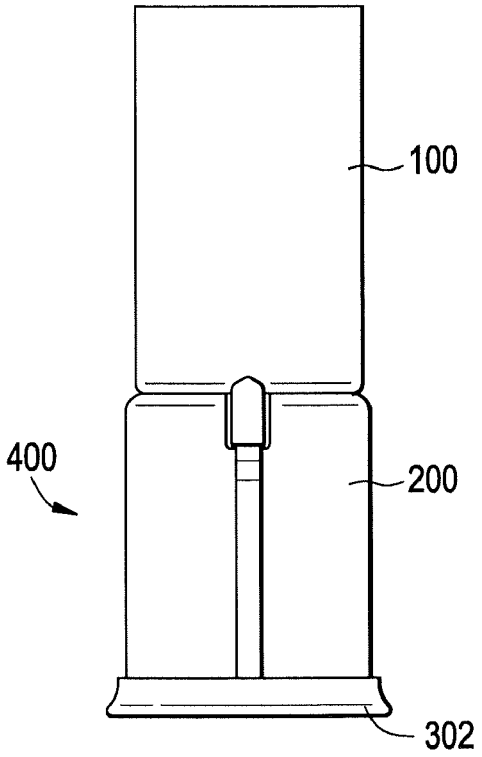
FIG. 12 is a side view of an end cap inserted and locked into an assembled socket assembly in accordance with one embodiment of the invention.
Figure 13:
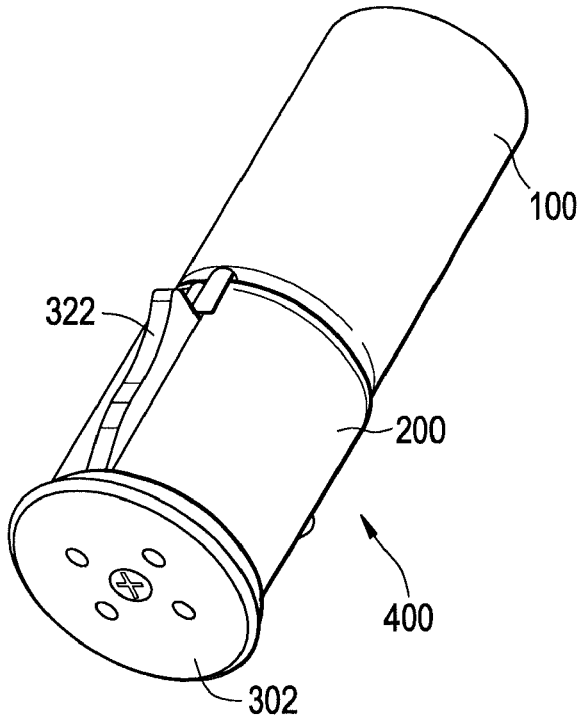
FIG. 13 is a perspective view of an end cap inserted and locked into an assembled socket assembly in accordance with one embodiment of the invention.
Figure 14:
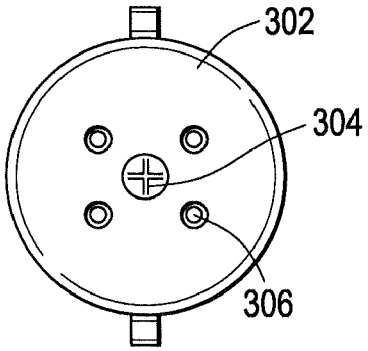
FIG. 14 is a view from the socket base plate end of an assembled socket assembly in accordance with one embodiment of the invention.
Figure 15:
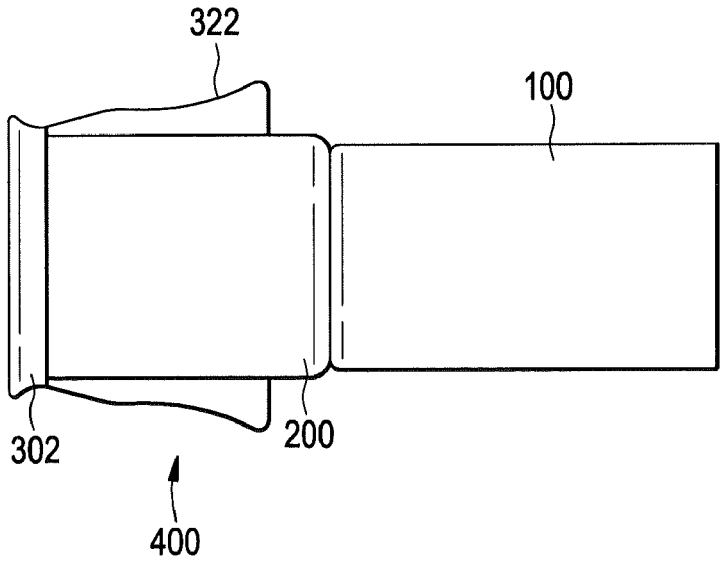
FIG. 15 is a side view of an assembled socket assembly showing a profile view of the clip arm pressure area, in accordance with one embodiment of the invention.
Figure 16:
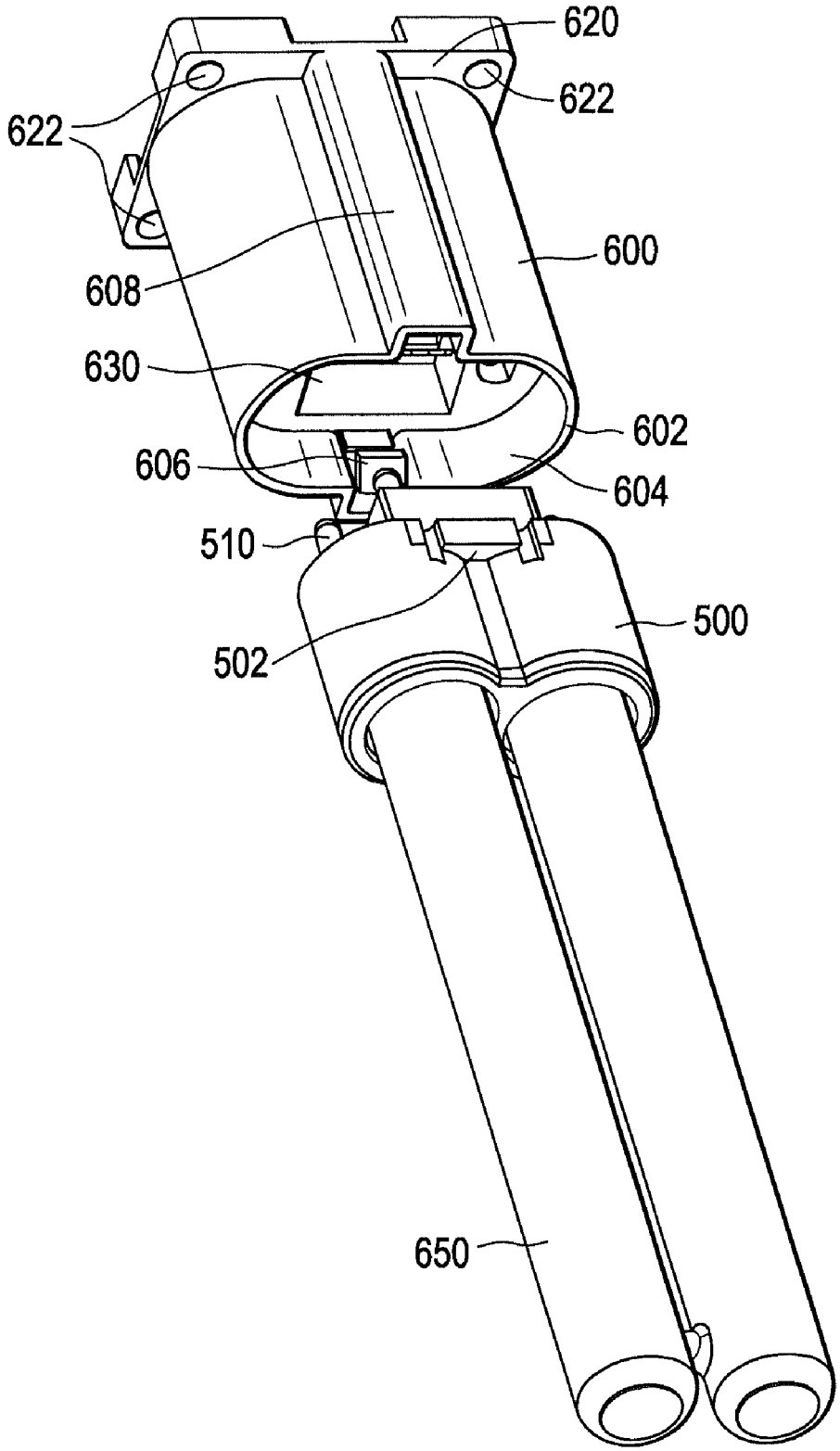
FIG. 16 is a perspective view of a disassembled end cap and socket housing in accordance with one embodiment of the invention.
Figure 17:
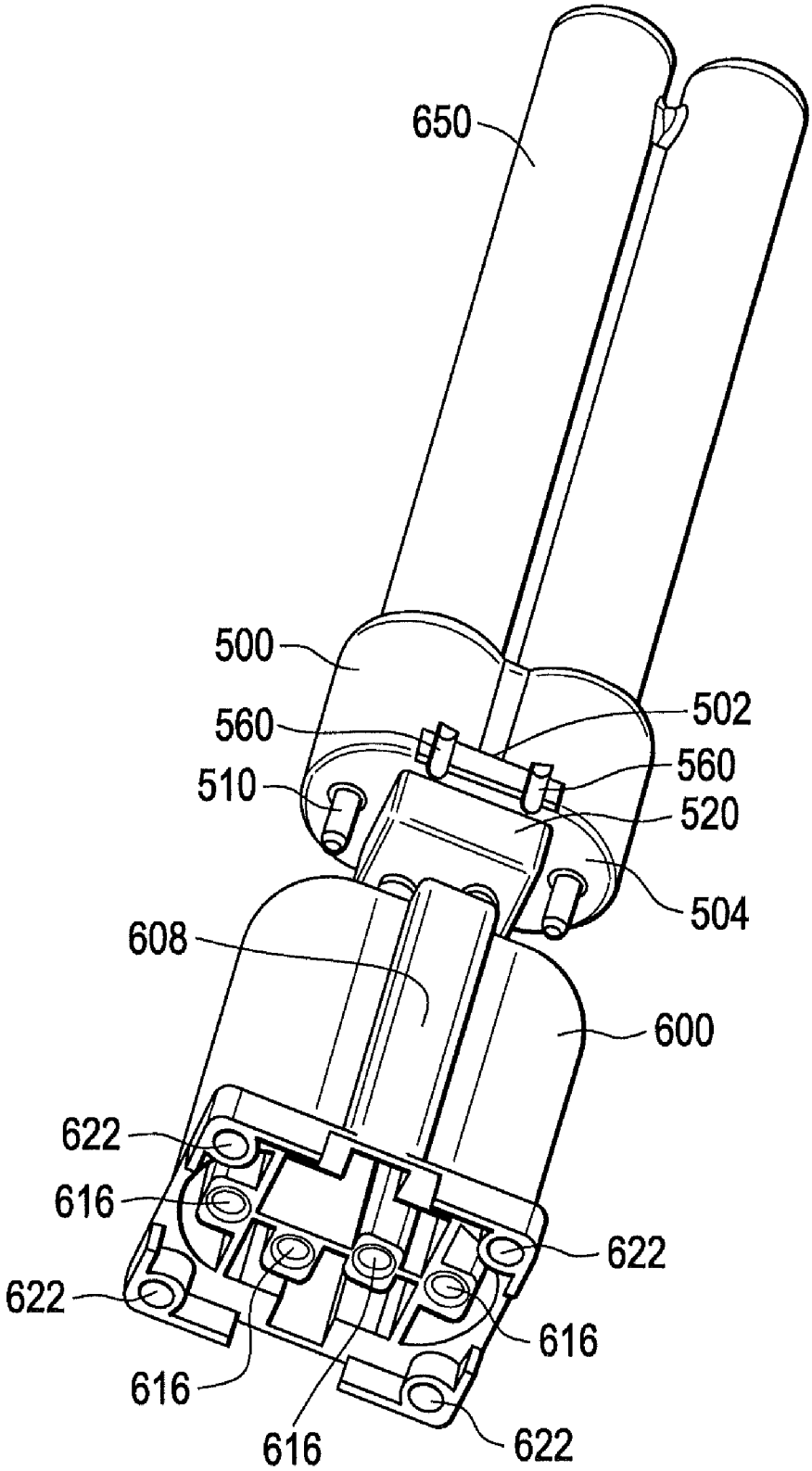
FIG. 17 is a perspective view of a disassembled end cap and socket housing in accordance with one embodiment of the invention.
Figure 18:
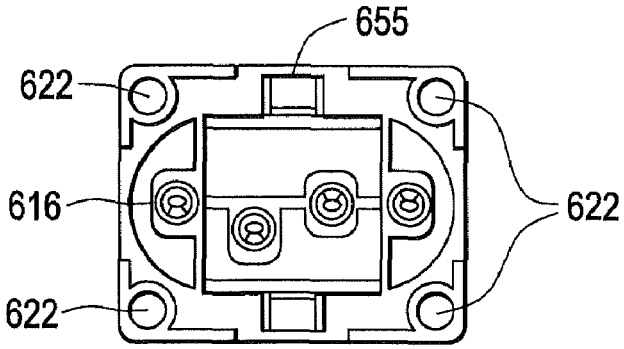
FIG. 18 is a view from the base end of a socket housing in accordance with one embodiment of the invention.
Figure 19:
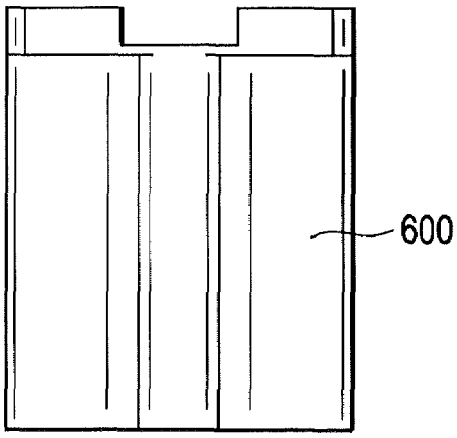
FIG. 19 is a side view of a socket housing in accordance with one embodiment of the invention.

As noted above, socket base 300 can be attached to socket body 200, creating socket assembly 400 and attached with a screw, as seen in FIG. 11. When assembled as indicated in FIG. 11, socket clip sections 310 are hidden inside of clip slots 220. Pressure areas 322 remain outside the circumference of the socket body 200.

Now the insertion and locking of end cap 100 into socket assembly 400 will be described as shown in FIG. 11. As described above, end cap pins 120 can be inserted into socket channels 210. As the end cap pins 120 are being inserted, slanted pushing face 112 of end cap clip 110 enters the clips slot 220 and comes into contact with slanted pushing face 312 of clip section 310. As the end cap 100 and end cap pins 120 are pushed further into socket assembly 400, the slanted pushing face 112 pushes against slanted pushing face 312, causing the clip arm 320 to displace inward towards a longitudinal axis of socket assembly 400.

Figure 6:
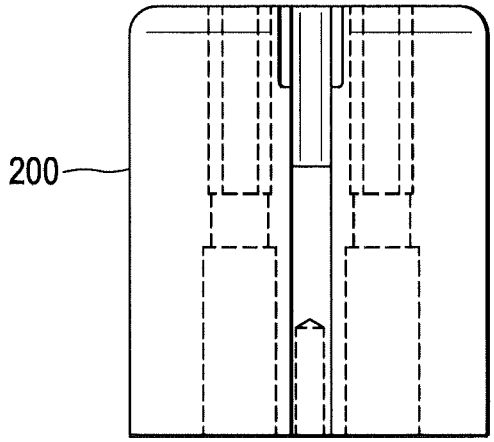
FIG. 6 is a side view of a socket body, with broken lines showing interior structure, in accordance with one embodiment of the invention.
Figure 7:
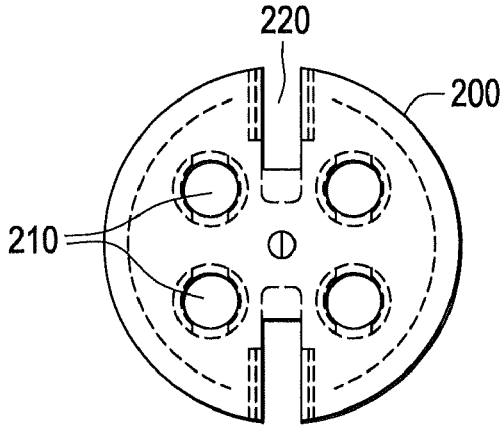
FIG. 7 is a top view of a socket body, in accordance with one embodiment of the invention.
Figure 8:
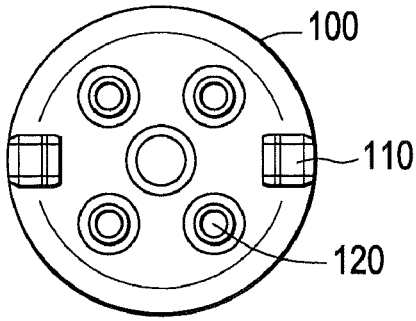
FIG. 8 is a view from the pin end of an end cap, in accordance with one embodiment of the invention.
Figure 9:
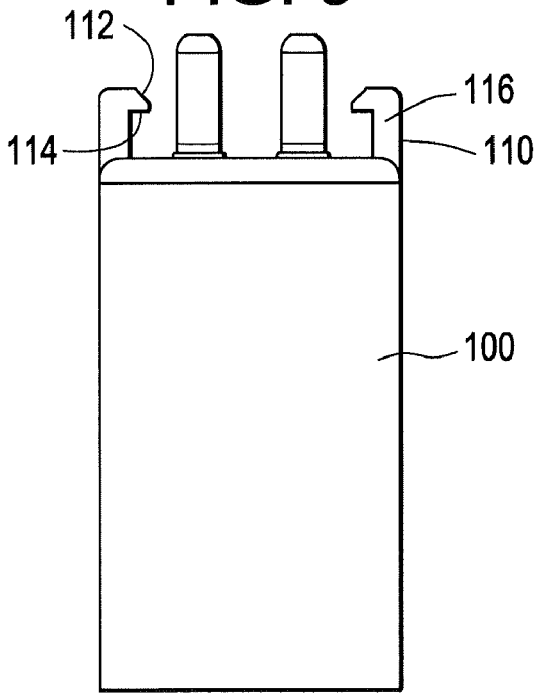
FIG. 9 is a side view of an end cap, in accordance with one embodiment of the invention.

As the clips are pushed farther in, slanted pushing face 112 will clear slanted pushing face 312. At this point, the elasticity of clip arm 320 will snap the clip section 310 back to its original position. At this point, flat locking face 114 and flat locking face 314 will be in contact with each other. The contact between flat locking face 114 and flat locking face 314 will prevent end cap 100 from being removed from socket assembly 400. FIGS. 6*a* and 6*b* illustrate one embodiment of the end cap 100 inserted into socket assembly 400.

To release end cap 100 from socket assembly 400, one would press on pressure areas 322. This would displace clip section 310 such that flat locking face 314 would no longer be in contact with flat locking face 114. With nothing to press against flat locking face 114, end cap 100 can be removed from socket assembly 400 very easily. After removing end cap 100, pressure on pressure areas 322 can be released, and clip section 310 will return to its original position.

Thus, this present snap locking operation apparatus overcomes the problems of the prior art discussed in the background at least because the lamp may be easily secured with minimal force, i.e., a "snap action" in contrast to a much more "difficult depress with more force and turn" two step motion of U.S. Pat. No. 6,334,902, or harder torque force required of U.S. Pat. No. 6,884,103, and will lock into place and remain secure even under vibration, such as vibration from water or air flowing through a disinfection apparatus to be disinfected even when hung vertically. It is also much smoother to operate than WO 2006/136026 for example and does not require to be inserted at an odd an awkward angle like WO 2006/136026. Thus, the present invention is also not merely a common sense improvement of the prior art at least because it requires many subtle features to be recognized and used in harmony, as described herein, which the prior art has not recognized to date, and has also not obviously been led to perform by common sense.

The present invention also is very safe because the electrical contacts 210 in the socket are difficult to reach with a finger, i.e., they are tucked away in a safe position from the user. Also, another safety problem with the prior art approaches is the complexity of the mechanical connection between the lamp and the base unit requiring the use of complex shaped springs, specialized connection lugs and the like. Further, a connection system that is predicated on a dual motion system such that if hard force pushing and twisting if used incorrectly for example may give rise to higher incidents of lamp breakage, electrical shock, and other damage to the lamp by field personal. Therefore, eliminating a forceful "push" necessary to deflect a heavy locking spring in a "push and twist" lock would be beneficial because the typically fragile glass lamp would then be subject to reduced force and stress. Thus, the present invention with its "snap action" is much safer and easier to use than the prior art.

FIGS. 16-31 show an alternative possible embodiment of an end cap and socket system. For example, an end cap may include an end cap body 500 that is generally tubular in shape. The end cap body 500 can be covered at a first end with an end cap face 504, and a second end of the end cap body is open and structured to receive a lamp 650. A plurality of end cap terminals 510 can be provided on end cap face 504, and provide electrical connections to the lamp 650 positioned inside end cap body 500. The embodiment of FIGS. 16-31 show that end cap terminals 510 are pin connectors, but alternative embodiments in which end cap terminals 510 are female connectors or other suitable connectors are also possible. A clip notch 502 can also be provided on an exterior side of the end cap body, and can interlock with a clip described in more detail below.

Figure 20:
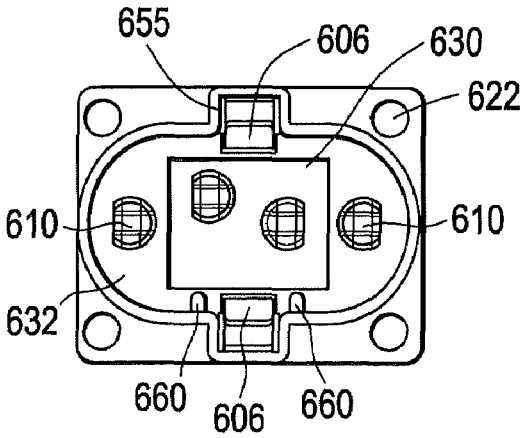
FIG. 20 is a view from the insertion end of a socket housing in accordance with one embodiment of the invention.
Figure 21:
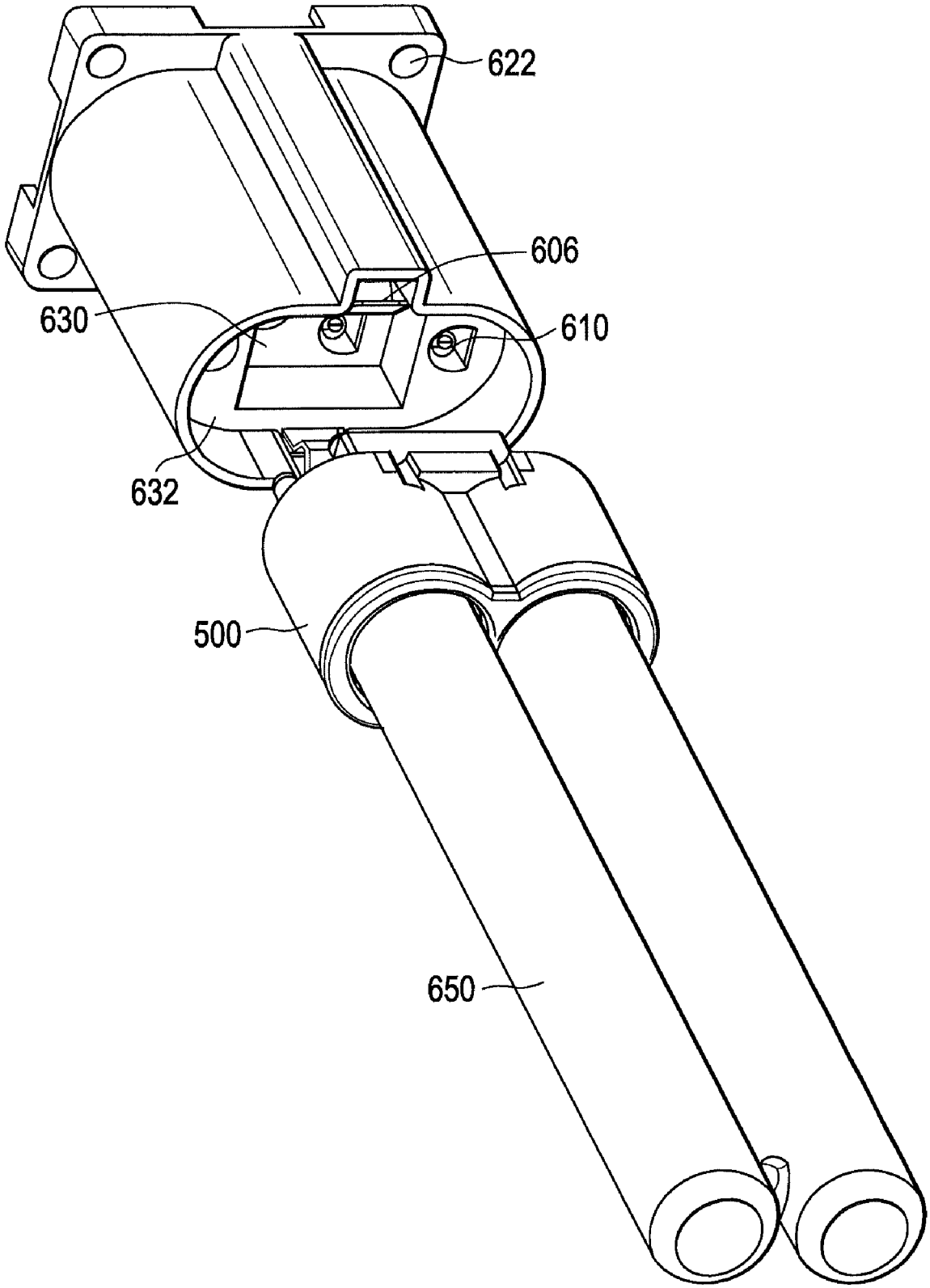
FIG. 21 is a perspective view of a disassembled end cap and socket housing in accordance with one embodiment of the invention.
Figure 22:
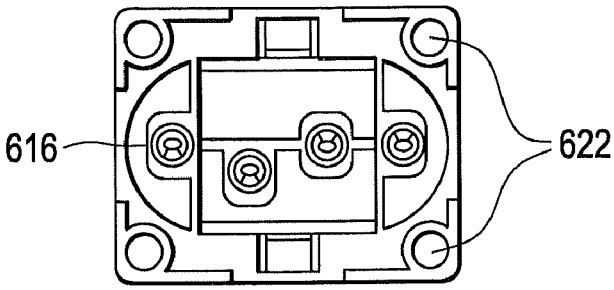
FIG. 22 is a view from the base end of a socket housing in accordance with one embodiment of the invention.
Figure 23:
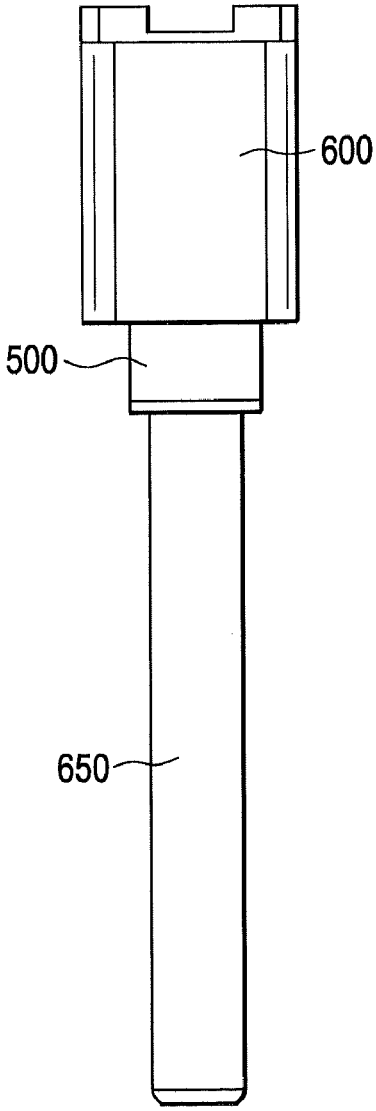
FIG. 23 is a side view of an assembled end cap and socket housing, shown with lamps, in accordance with one embodiment of the invention.
Figure 24:
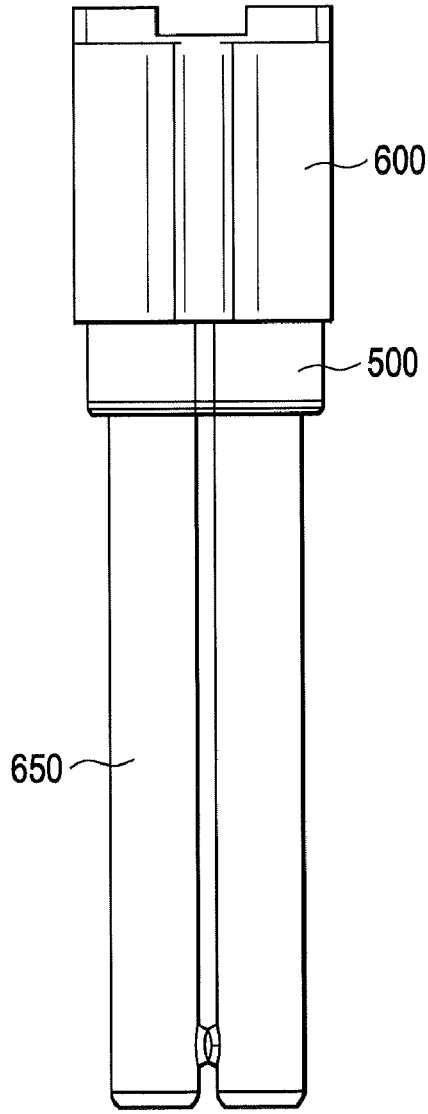
FIG. 24 is a side view of an assembled end cap and socket housing, shown with lamps, in accordance with one embodiment of the invention.
Figure 25:
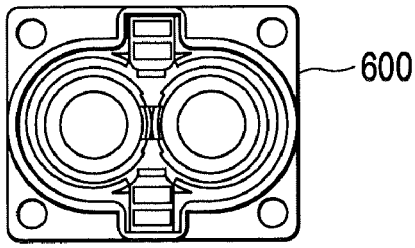
FIG. 25 is a view from the lamp end of an assembled end cap an socket housing with lamps, in accordance with one embodiment of the invention.
Figure 28:
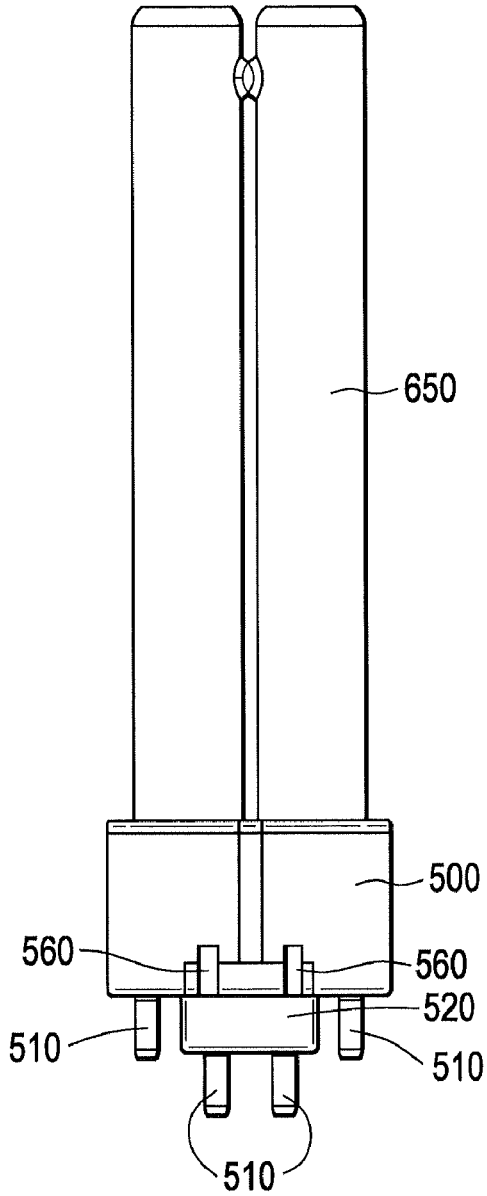
FIG. 28 is a side view of an end cap with lamps, in accordance with one embodiment of the invention.
Figure 29:
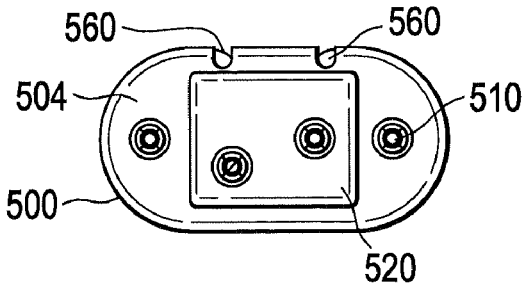
FIG. 29 is a view from the end cap pin end of an end cap, in accordance with one embodiment of the invention.

An embodiment of a socket includes a socket body 600 that is generally tubular in shape, and a socket face 632 covers a first end of the tubular socket body 600. A receiving wall 604 is positioned at an outer periphery of socket face 632 and extends in a direction away from socket body 600 to form a receiving area 602. Receiving wall 604 may have a circumference larger than a circumference of end cap body 500. Thus, end cap body 500 can be received within receiving wall 604. Additionally, a plurality of socket terminals 610 may be provided on socket face 632. The embodiments of FIGS. 16-31 show that socket terminals are female connectors, but alternative embodiments in which socket terminals 610 are pin connectors or other suitable connectors are also possible. The socket can also be provided with a resilient clip 606 provided within a channel 608 (reference numeral 655 indicates the interior portion of channel 608). Resilient clip 606 can be provided on an inner side of the receiving wall, and is structured to interlock with clip notch 502. Resilient clip 606 is an important safety feature because it helps to hold the end cap seated firmly in place, thus reducing the risk of electric shock, fire, injury, or property damage if the lamp were to become accidentally disconnected. The socket may also include a socket base 620 provided with exterior wiring holes 616 so that electrical connections can be established between socket terminals 610 and a power source There are also a number of other safety features that help to insure that a lamp is properly coupled to a socket. For example, as best seen in FIG. 20 and FIG. 29, socket terminals 610 and end cap terminals 510 can be arranged asymmetrically. In the embodiment shown, the asymmetry is caused because one terminal is out of line with the others. However, it will be recognized that there are many possible asymmetric arrangements of terminals that can be used. For example, in FIG. 42, the reference letter "P" indicates possible positions of end cap terminals 510. It will be understood that these terminal positions P are not the only possible arrangements, and that a large number of suitable arrangements are possible. This asymmetric arrangement of terminals helps to insure proper connection because the end cap can only be fully inserted into the socket in one orientation.

Figure 26:
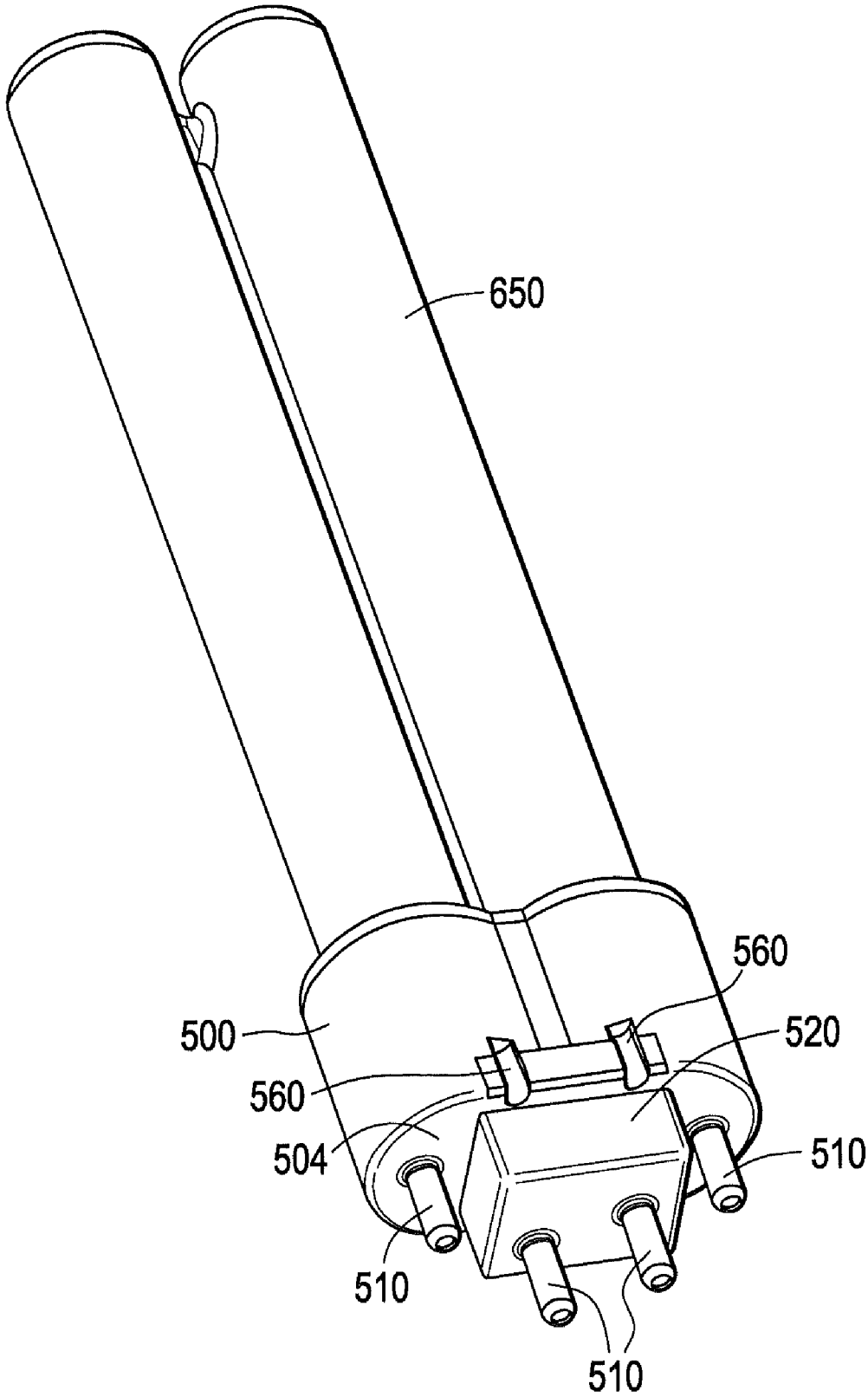
FIG. 26 is a perspective view of an end cap with lamps, in accordance with one embodiment of the invention.
Figure 27:
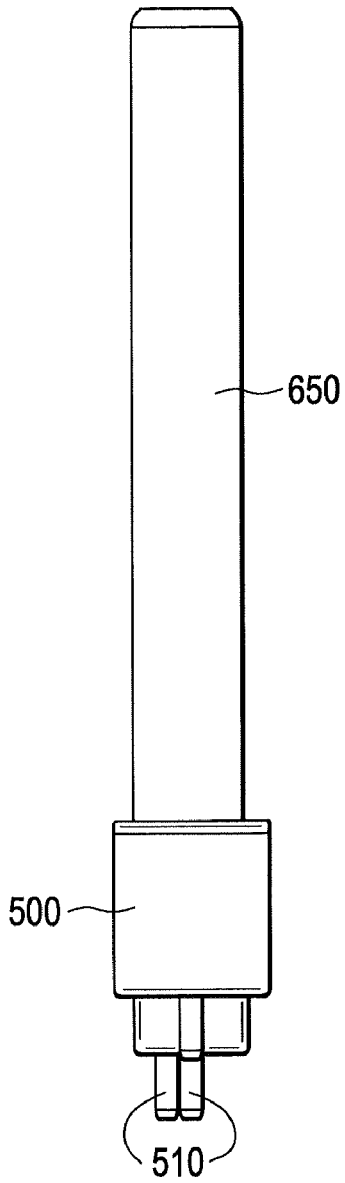
FIG. 27 is a side view of an end cap with lamps, in accordance with one embodiment of the invention.

Another important safety feature is that the end cap can be provided with a step portion 520 that extends from the end cap face 504. As seen in FIG. 26, at least one end cap terminal 510 can extend from step portion 520. The complementary socket will include a recess portion 630 that can accommodate step portion 520. Recess portion 630 will include at least one socket terminal 610 to correspond to the one or more end cap terminals 510 positioned on step portion 520. It is readily seen that an end cap with step portion 520 cannot be used with a standard socket that does not include a recess portion. Therefore, step portion 520 helps to insure that the end cap will only be used with a properly mated socket.

Figure 32A:
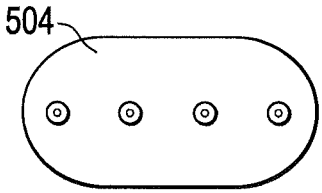
FIGS. 32-40 are various views of end caps in accordance with various embodiments.
Figure 32B:
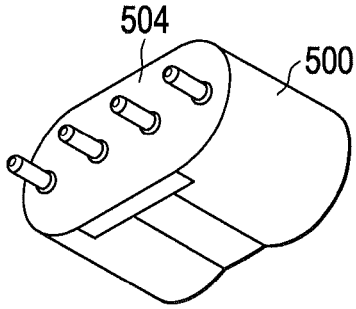
Figure 32C:
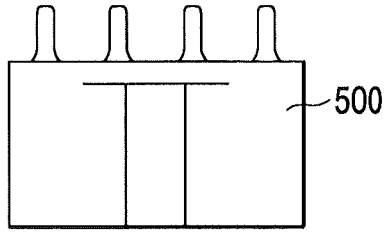
Figure 33A:
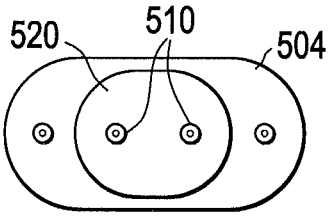
Figure 33B:
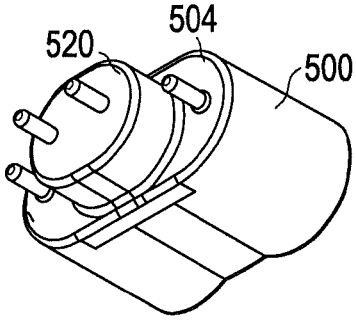
Figure 33C:
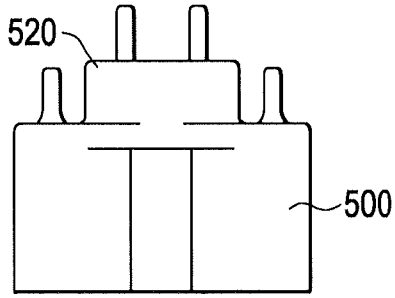
Figure 34A:
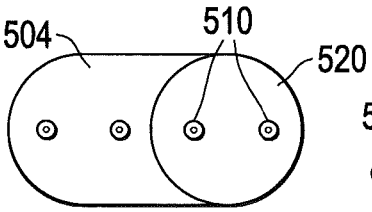
Figure 34B:
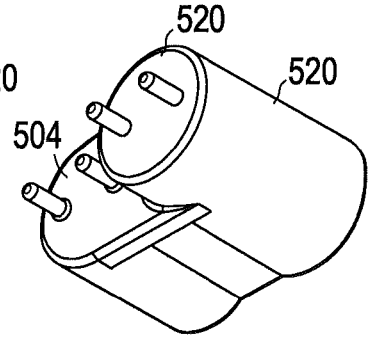
Figure 34C:
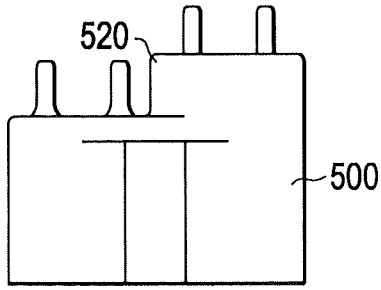
Figure 35A:
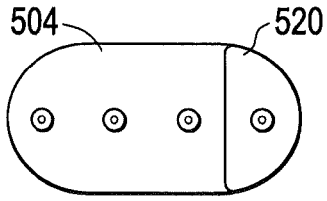
Figure 35B:
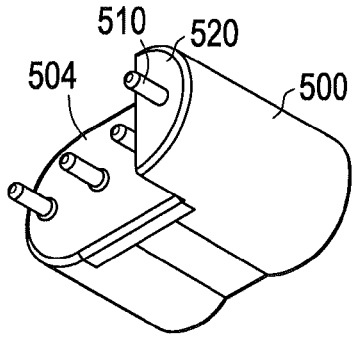
Figure 35C:
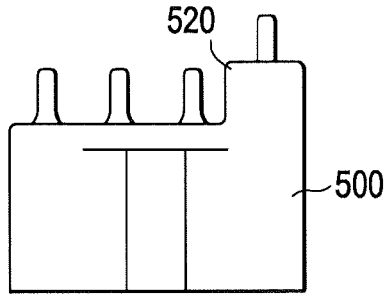
Figure 38A:
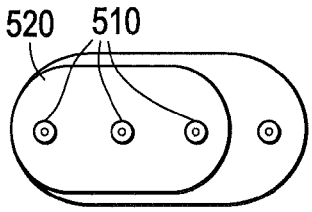
Figure 38B:
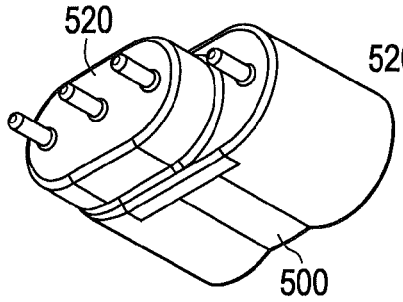
Figure 38C:
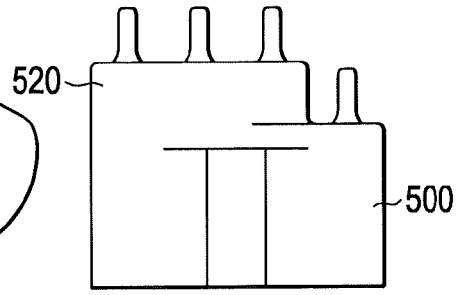
Figure 39A:
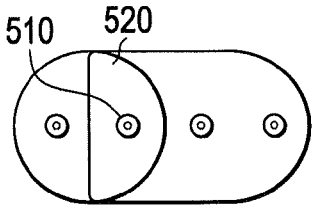
Figure 39B:
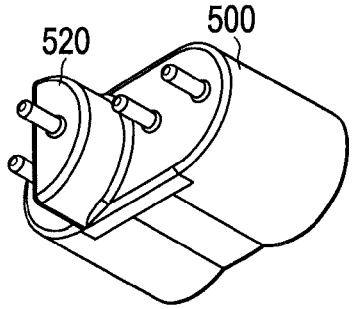
Figure 39C:
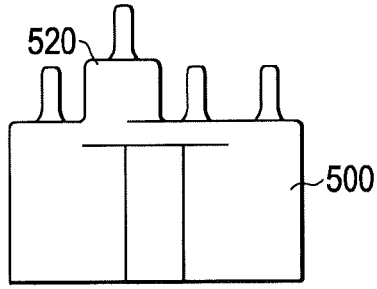

Additionally, while FIGS. 16-31 show an embodiment with a single step portion 520 having two end cap terminals 510, it will be understood that many different variations are possible. FIGS. 33-40 illustrate at least some of these possible variations, and FIG. 32 illustrates a conventional example of a standard 2 G-11 base for the sake of comparison. For example, the size and the position of the step portion can be varied. For example, FIG. 34 shows a step portion 520 that is shifted to one end of the end of end cap face 504 instead of being positioned in the middle. FIG. 35 shows a smaller step portion 520 shifted to one end, and FIG. 39 shows a smaller step portion 520 positioned in the middle. FIG. 38 on the other hand, shows a larger step portion 520. Similarly, there are variations in which one end cap terminal 510 (see FIGS. 35 and 39) or three end cap terminals 510 (see FIG. 38) are provided on step portion 520. It will be understood that for any of these variations, the corresponding socket with have appropriately sized and positioned recess portions 630.

Figure 36A:
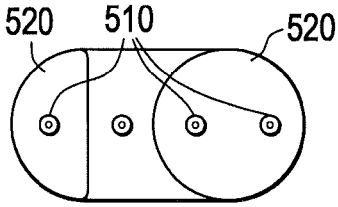
Figure 36B:
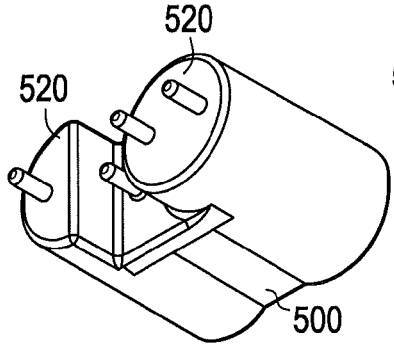
Figure 36C:
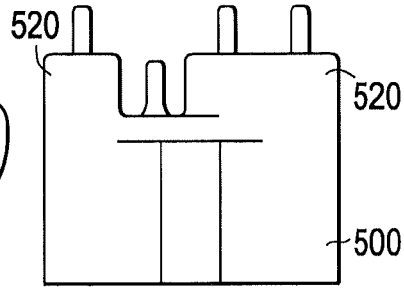
Figure 37A:
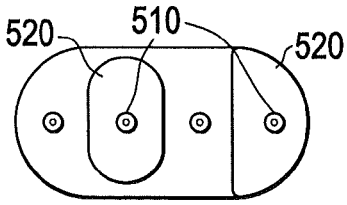
Figure 37B:
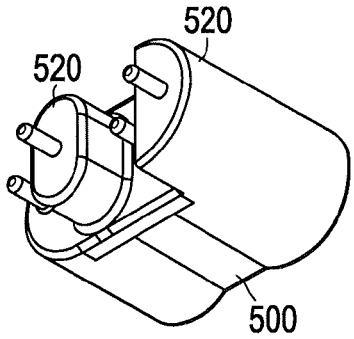
Figure 37C:
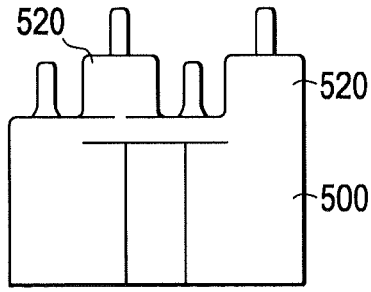
Figure 40A:
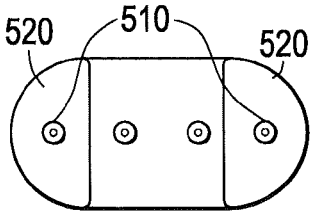
Figure 40B:
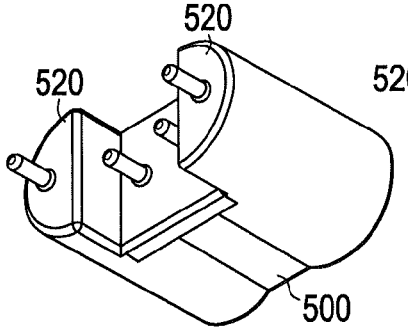
Figure 40C:
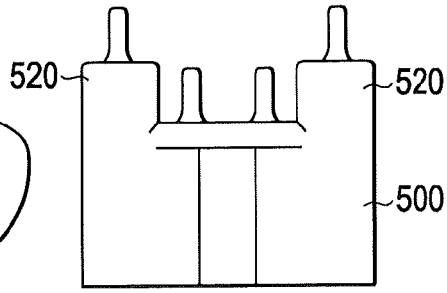

There are also variations in which multiple step portions 520 can be used, as seen in FIGS. 36, 37, and 40, with each step portion 520 having one or more end cap terminals 510 positioned thereon. When using an end cap with multiple step portions 520, it will be understood that the corresponding socket will have multiple recess portions 630 corresponding to the multiple step portions 520.

Figure 30:
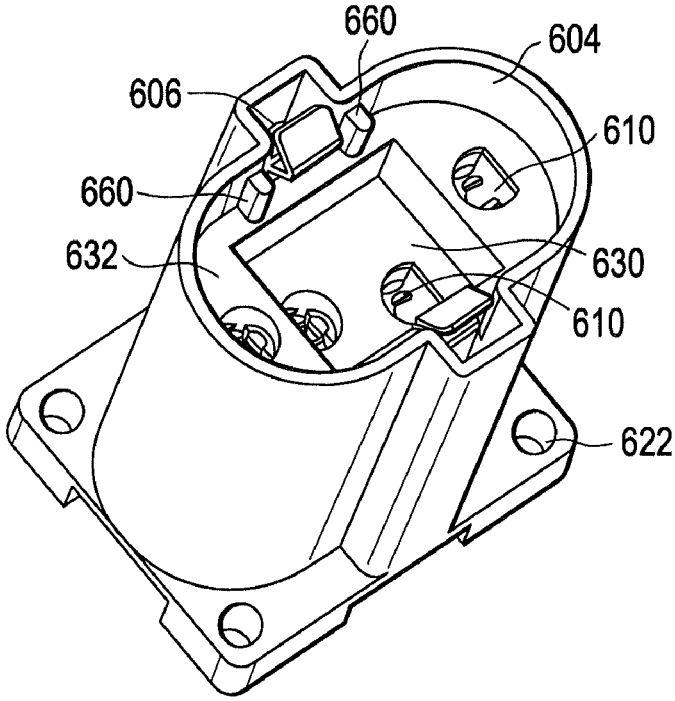
FIG. 30 is a perspective view of a socket housing, in accordance with one embodiment of the invention.
Figure 31:
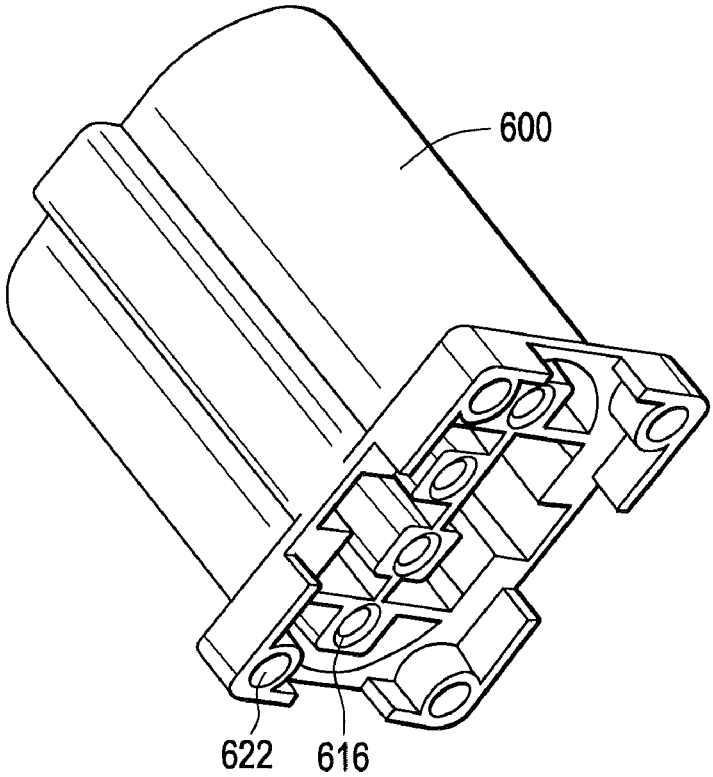
FIG. 31 is a perspective view of a socket housing, in accordance with one embodiment of the invention.

Another important safety feature is the use of key ribs and key grooves on the end cap and sockets. For example, present FIG. 30 shows key ribs 660 that project from receiving wall 604, and FIGS. 28-29 show key grooves 560 cut into the end cap body 500. When the end cap and socket are properly aligned, key ribs 660 will couple with key grooves 560 and the end cap can be fully inserted into the socket. If the end cap and socket are misaligned, key ribs 660 will abut with end cap body 500 and prevent full insertion of the end cap.

It will be recognized that many variations in the position, size, shape, and number of the key ribs and key grooves are possible. For example, multiple key ribs 660 can be positioned at different positions around receiving wall 604, and key ribs 660 can be shaped as triangles, semi-circles, or any other possible shape. Key grooves 560 on the end cap can be similarly varied.

Figure 41:
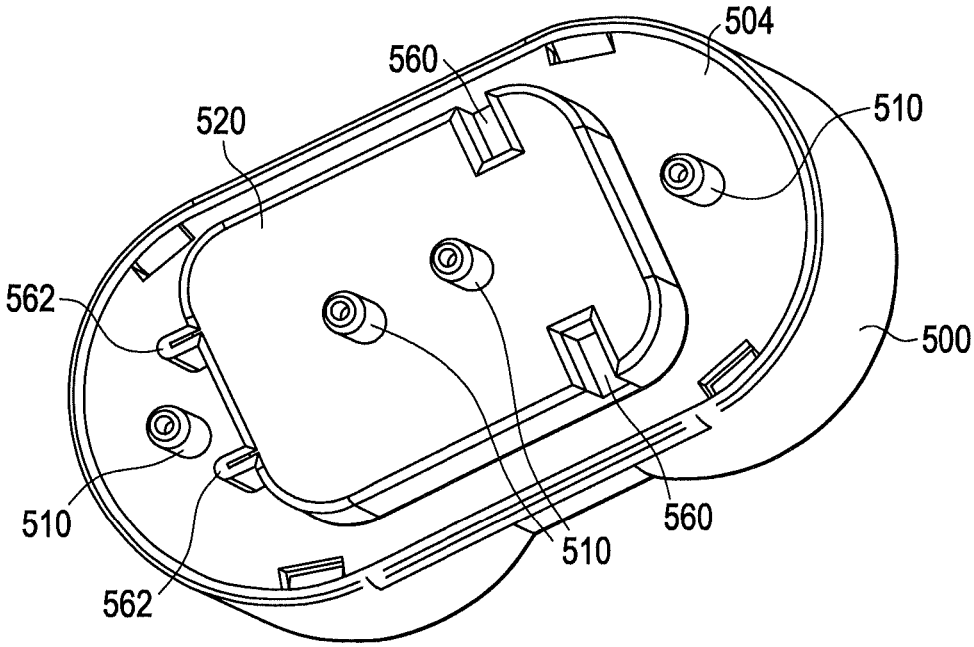
FIG. 41 is a bottom perspective view of an end cap in accordance with at least an embodiment.
Figure 42:
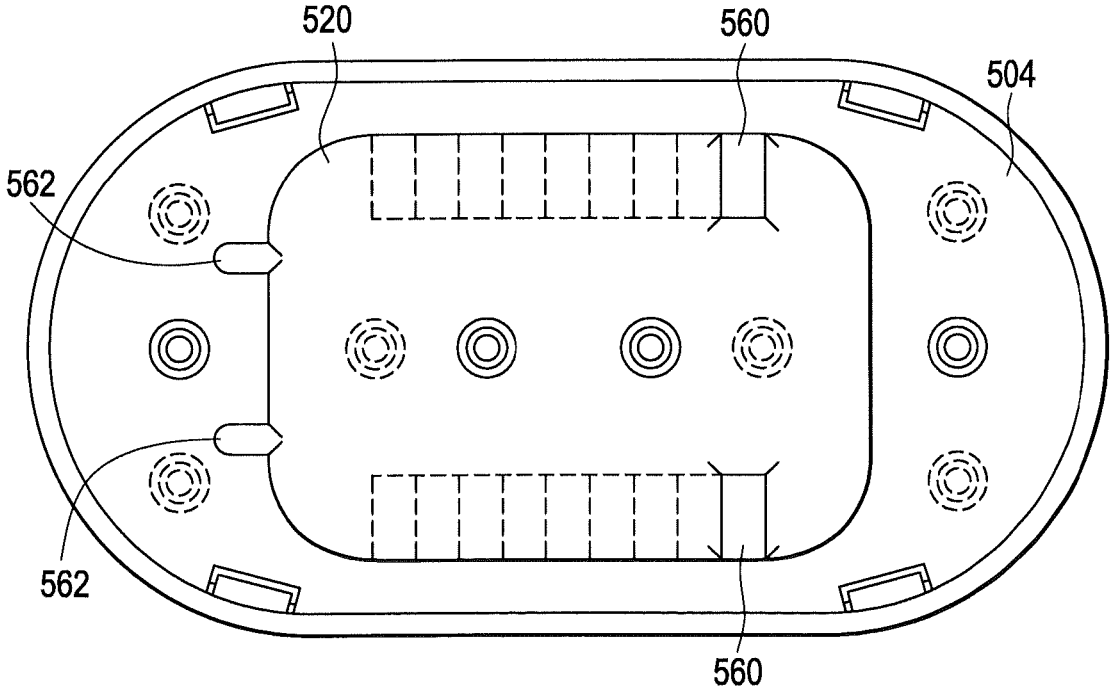
FIG. 42 is a plan view of an end cap in accordance with at least an embodiment.
Figure 43:
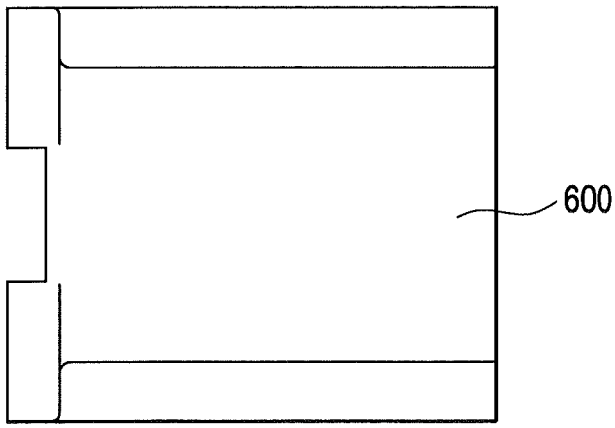
FIGS. 43-47 are various views a socket in accordance with at least an embodiment.
Figure 44:
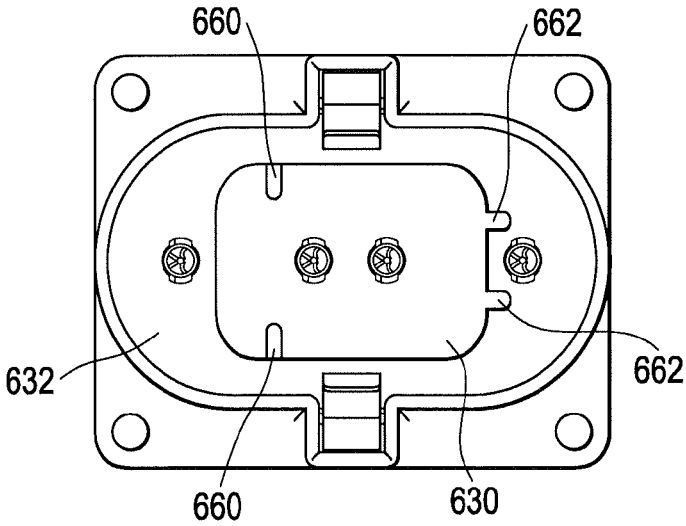
Figure 45:
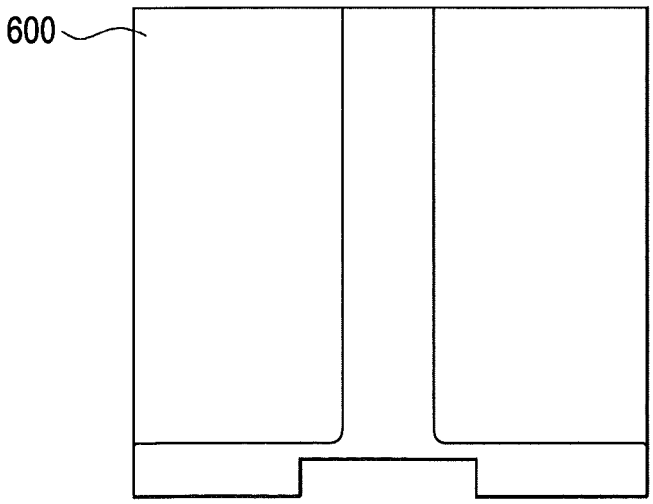
Figure 46:
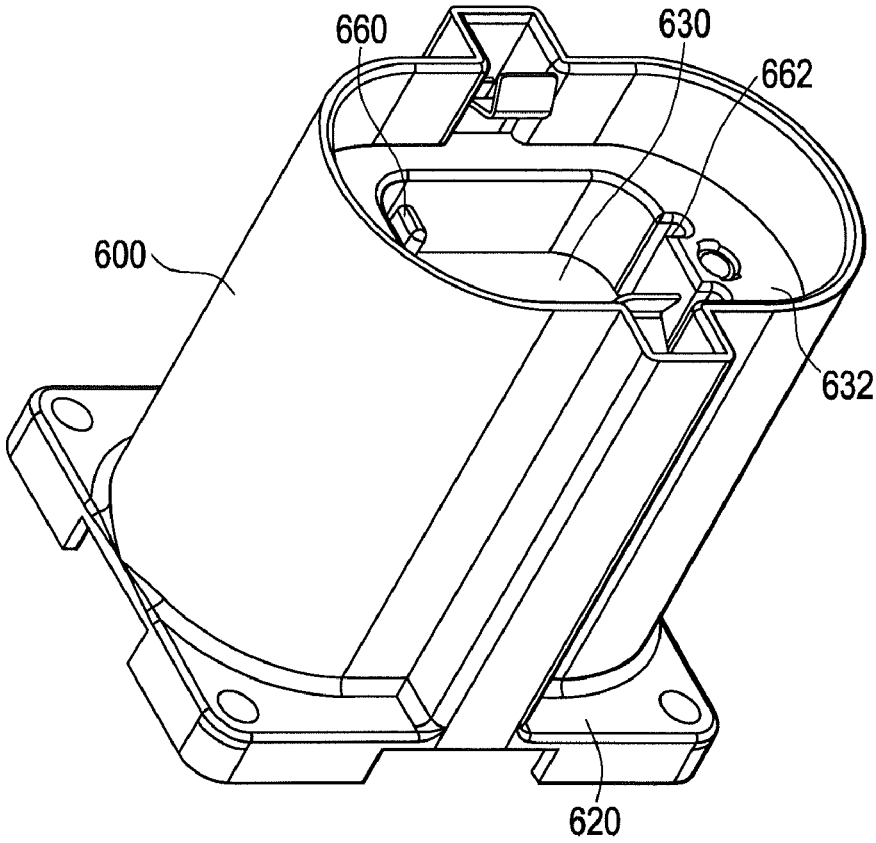
Figure 47:
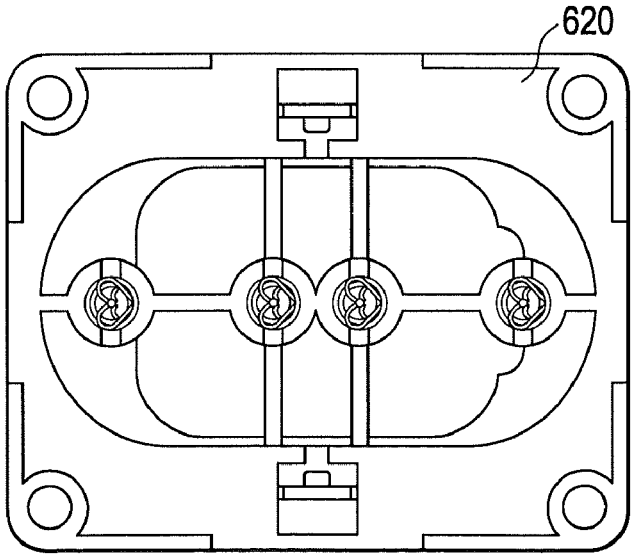

Alternatively, as seen in FIGS. 41, 42, 44, and 46, key ribs 660 can instead be positioned to project into recess area 630, and the corresponding key grooves 560 can be formed in the step portion 520 of the end cap. The reverse is also possible, i.e., key grooves 662 can be cut into socket face 632, and key ribs 562 can be provided on the side of step portion 520. It will also be apparent that key ribs and key grooves can be mixed on the same piece. For example, as seen in FIGS. 41-42, one part of a step portion 520 may have a key rib 562, while a different part of the step portion 520 may have a key groove 560. In other words, in FIGS. 41-42, the end cap has both key ribs and key grooves.

It will also be appreciated that the positions of key grooves 560 and key ribs 562 can be greatly varied. For example, in FIG. 42, reference letter "K" indicates at least some possible alternate positions of key groove 560. These positions are not the only possible positions, however. It will be understood that key grooves 560 can also be positioned on the short side of step portion 520, or any other suitable position. Likewise, key ribs 562 can also be positioned at any number of potential positions around step portion 520. The corresponding key ribs 660 and key grooves 662 on the socket can also be moved to accommodate the arrangement of the keys on the end cap.

As noted above, there are many alignment features designed to ensure that the end cap is properly aligned with the socket when they are coupled, for example, the key ribs and grooves, the step portions and recess portions, and the asymmetric terminal arrangements. These alignment features result in significant and non-trivial benefits over conventional devices.

For example, it will be appreciated that the alignment features described above can ensure that there is only one possible way for an end cap to fit into the socket. This is an important safety feature because it prevents the end cap terminals 510 from mistakenly being connected to the wrong polarity of a power source, for example, which could damage the lamp. Thus, the alignment features described above can help to prevent damage to lamps by ensuring proper coupling.

Additionally, the alignment features described above can help to ensure that a lamp is only coupled with an appropriate socket. For example, an appropriate socket may have a given configuration of key ribs or grooves or recess portions, and unless the end cap is a properly corresponding end cap that has complementary key ribs, key grooves, and/or step portions, the end cap cannot be coupled to the socket.

There features also provide important safety benefits. For example, if terminals are improperly connected to the wrong polarities or improper power source, sparks can be generated that pose a fire risk, or the user may be exposed to electric shock. Each of the alignment features above helps to ensure proper coupling of lamp bases and sockets, thus reducing the risk of these hazards and protecting the safety of the user.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A end cap and socket system for use with a lamp, comprising:

an end cap comprising:

an end cap body that is tubular in shape and has a first end and a second end;

an end cap face provided at the first end of the end cap body;

a plurality of end cap terminals provided on the end cap face; and a clip notch provided on an exterior side of the end cap body;

wherein the second end of the end cap body is open and structured to receive the lamp therein;

a socket comprising:

a socket body that is generally tubular in shape;

a socket face provided at a first end of the socket body;

a receiving wall extending from an outer periphery of the socket face and extending in a direction away from the socket body, the receiving wall having a circumference larger than a circumference of the end cap body such that the end cap body can be received within the receiving wall;

a plurality of socket terminals provided on the socket face and structured to couple with the plurality of end cap terminals; and a resilient clip provided on an inner side of the receiving wall, the resilient clip being structured to snap into and interlock with the clip notch to retain the end cap in the socket.

2. The end cap and socket system of claim 1, wherein the plurality of end cap terminals and the plurality of socket terminals are arranged asymmetrically.

3. The end cap and socket system of claim 1, wherein the end cap comprises a step portion extending from the end cap face;

at least one of the plurality of end cap terminals is provided on the step portion;

the socket face comprises a recess portion;

at least one of the plurality of socket terminals is provided on the recess portion;

and the recess portion is structured so as to receive the step portion therein.

4. The end cap and socket system of claim 3, wherein the end cap comprises a plurality of step portions extending from the end cap face;

at least one of the plurality of end cap terminals is provided on each of the plurality of step portions;

the socket face further comprises a plurality of recess portions;

at least one of the plurality of socket terminals is provided on each of the plurality the recess portions;

and the plurality of recess portions are structured so as to receive the plurality of step portions therein.

5. The end cap and socket system of claim 3, wherein the end cap further comprises a key groove cut into the step portion;

the socket surface further comprises a key rib projecting into the recess portion; and the key groove and key rib are structured to couple together.

6. The end cap and socket system of claim 3, wherein the end cap further comprises a key rib projecting from the step portion;

the socket surface further comprises a key groove cut into the socket surface; and the key groove and key rib are structured to couple together.

7. The end cap and socket system of claim 1, wherein the socket comprises a key rib projecting from the receiving wall;

the end cap comprises a key groove cut into the end cap body; and the key groove and the end key rib are structured to couple together.

8. The end cap and socket system of claim 3, wherein the end cap further comprises an end cap key groove cut into the step portion and an end cap key rib projecting from the step portion;

the socket surface further comprises a socket key rib projecting into the recess portion and a socket key groove cut into the socket surface;

the socket key groove and the end cap key rib are structured to couple together; and the socket key rib and the end cap key groove are structured to couple together.

9. An end cap for use with a lamp, comprising:

an end cap body that is tubular in shape and has a first end and a second end;

an end cap face provided at a first end of the end cap body;

a step portion extending from the end cap face a plurality of end cap terminals; and a clip notch provided on an exterior side of the end cap body;

wherein the second end of the end cap body is open and structured to receive the lamp therein;

at least one of the plurality of end cap terminals is provided on the end cap face; and at least one of the plurality of end cap terminals is provided on the step portion.

10. The end cap of claim 9, wherein the plurality of end cap terminals are arranged asymmetrically.

11. The end cap of claim 9, wherein the end cap comprises a plurality of step portions extending from the end cap face;

at least one of the plurality of end cap terminals is provided on each of the plurality of step portions.

12. The end cap of claim 9, wherein the end cap further comprises a key groove cut into the step portion.

13. The end cap of claim 9, wherein the end cap further comprises a key rib projecting from the step portion.

14. The end cap of claim 9, wherein the end cap further comprises an end cap key groove cut into the step portion and an end cap key rib projecting from the step portion.

15. The end cap of claim 9, wherein the end cap comprises a key groove cut into the end cap body.

16. A socket structured to receive an end cap for a lamp, the socket comprising:

a socket body that is generally tubular in shape;

a socket face provided at a first end of the socket body;

a receiving wall extending from an outer periphery of the socket face and extending in a direction away from the socket body, the receiving wall having a circumference larger than a circumference of the end cap such that the end cap can be received within the receiving wall;

a plurality of socket terminals provided on the socket face; and a resilient clip provided on an inner side of the receiving wall, wherein the socket face comprise a recess portion; and at least one of the plurality of socket terminals is provided on the recess portion.

17. The socket of claim 16, wherein the plurality of socket terminals are arranged asymmetrically.

18. The socket of claim 16, wherein the socket face further comprises a plurality of recess portions; and at least one of the plurality of socket terminals is provided on each of the plurality the recess portions.

19. The socket of claim 16, wherein the socket surface further comprises a key rib projecting into the recess portion.

20. The socket of claim 16, wherein the socket surface further comprises a key groove cut into the socket surface.

21. The socket of claim 16, wherein the socket surface further comprises a socket key rib projecting into the recess portion and a socket key groove cut into the socket surface.

22. The socket of claim 16, wherein the socket comprises a key rib projecting from the receiving wall.

* * * * *